US011763731B2

(12) United States Patent
Holland et al.

(10) Patent No.: US 11,763,731 B2
(45) Date of Patent: Sep. 19, 2023

(54) DISPLAY APPARATUS AND METHOD OF OPERATION FOR A DISPLAY APPARATUS

(71) Applicant: OSRAM Opto Semiconductors GmbH, Regensburg (DE)

(72) Inventors: Brendan Holland, Regensburg (DE); Gunnar Petersen, Regensburg (DE); Daniel Richter, Bad Abbach (DE)

(73) Assignee: OSRAM OPTO SEMICONDUCTORS GMBH, Regensburg (DE)

( * ) Notice: Subject to any disclaimer, the term of this patent is extended or adjusted under 35 U.S.C. 154(b) by 91 days.

(21) Appl. No.: 17/610,631

(22) PCT Filed: Apr. 27, 2020

(86) PCT No.: PCT/EP2020/061617

§ 371 (c)(1),
(2) Date: Nov. 11, 2021

(87) PCT Pub. No.: WO2020/229147

PCT Pub. Date: Nov. 19, 2020

(65) Prior Publication Data

US 2022/0319400 A1 Oct. 6, 2022

(30) Foreign Application Priority Data

May 13, 2019 (DE) ..... 10 2019 112 456.5

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01); *G09G 2300/0809* (2013.01);
(Continued)

(58) Field of Classification Search
CPC ..... G09G 3/2074; G09G 3/32; G09G 3/342; G09G 3/3426; G09G 2310/066;
(Continued)

(56) References Cited

U.S. PATENT DOCUMENTS 10,629,573 B2 * 4/2020 Perälä ..... G09G 3/32
10,706,799 B2 * 7/2020 Chen ..... G09G 3/3611
(Continued)

FOREIGN PATENT DOCUMENTS

DE 10 2017 129 981 A1 6/2019

OTHER PUBLICATIONS

International Search Report dated Sep. 25, 2020 for corresponding International Patent Application No. PCT/EP2020/061617, along with an English translation.
(Continued)

*Primary Examiner* — Jason M Mandeville
(74) *Attorney, Agent, or Firm* — HAUPTMAN HAM, LLP

(57) ABSTRACT

A display apparatus includes a multiplicity of picture elements for emitting visible light in different colors in an adjustable manner by means of a plurality of semiconductor layer sequences. Each of the picture elements has a plurality of types of pixels and each type of pixels is configured for emitting light of a specific color. The pixels are each subdivided into a plurality of sub-pixel. All the sub-pixels are configured for emitting light of the same color out of the display apparatus without further color change. At least two sub-pixels within each pixel have emission areas of different sizes. An electrical control unit is assigned to each pixel. The control units are each configured to automatically control the sub-pixels of a relevant pixel depending on an energization
(Continued)

Figure 1:
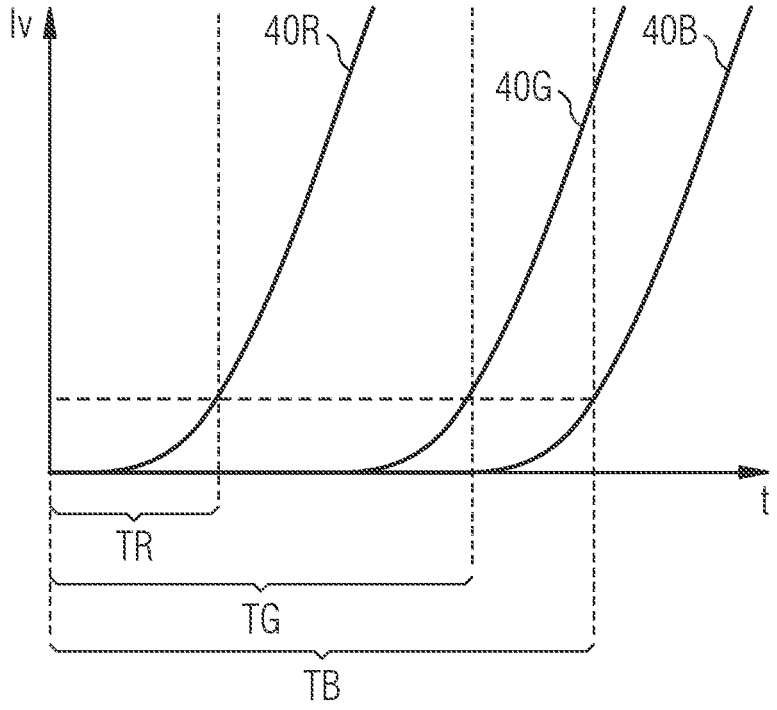

intensity in such a way that a light-emitting area of the relevant pixel increases in stepped fashion with the energization intensity.

16 Claims, 7 Drawing Sheets

(52) U.S. Cl.
CPC ..... *G09G 2310/066* (2013.01); *G09G 2320/0242* (2013.01); *G09G 2320/0653* (2013.01); *G09G 2320/0686* (2013.01); *G09G 2330/023* (2013.01)

(58) Field of Classification Search
CPC ... G09G 2320/0242; G09G 2320/0653; G09G 2320/0686; G09G 2330/023; G09G 2300/0809
USPC ..... 345/76, 692
See application file for complete search history.

(56) References Cited

U.S. PATENT DOCUMENTS

| | | | | |
|---|---|---|---|---|
| 11,145,251 | B2 * | 10/2021 | Watsuda | G09G 3/3208 |
| 2008/0197784 | A1 | 8/2008 | Benzarti | |
| 2015/0145906 | A1 | 5/2015 | Uetake | |
| 2016/0372514 | A1 | 12/2016 | Chang et al. | |
| 2018/0323180 | A1 * | 11/2018 | Cok | H01L 23/5386 |
| 2019/0096324 | A1 | 3/2019 | Soda | |
| 2019/0386486 | A1 * | 12/2019 | Koch | G05F 1/573 |
| 2020/0052033 | A1 * | 2/2020 | Iguchi | H01L 27/156 |

OTHER PUBLICATIONS

Written Opinion issued for corresponding International Patent Application No. PCT/EP2020/061617 dated Sep. 25, 2020.

Fan et al., "III-nitride micro-emitter arrays: development and applications", Journal of Physics D: Applied Physics. Institute of Physics Publishing Ltd. GB., vol. 41, No. 9, May 7, 2008, pp. 1-12, cited in NPL Nos. 1 and 2.

* cited by examiner

DISPLAY APPARATUS AND METHOD OF OPERATION FOR A DISPLAY APPARATUS

CROSS REFERENCE TO RELATED APPLICATION

This application is a National Stage of International Application No. PCT/EP2020/061617, filed on Apr. 27, 2020, which designates the United States and was published in Europe, and which claims priority to German Patent Application No. 10 2019 112 456.5, filed on May 13, 2019, in the German Patent Office. Both of the aforementioned applications are hereby incorporated by reference in their entireties.

A display apparatus is specified. Furthermore, a method of operation for a display apparatus is specified.

The documents DE 10 2017 129 981 A1 and DE 10 2019 106 527 A1 relate to display apparatuses having a high dynamic range.

One object to be achieved is to specify a display apparatus that enables efficient rendering of images with a high dynamic range.

This object is achieved, inter alia, by means of a display apparatus having the features of claim 1. The rest of the claims relate to preferred developments.

In accordance with at least one embodiment, the display apparatus comprises a multiplicity of picture elements. The picture elements are in each case configured for emitting visible light in different colors in an adjustable manner. That is to say that, depending on control, the picture elements can emit colored light such as red, green or blue light or else mixed-colored light such as white light. Furthermore, an intensity of the light emitted by the picture elements during operation is adjustable.

In accordance with at least one embodiment, light generation in the picture elements is based on a single semiconductor layer sequence or, particularly preferably, on a plurality of semiconductor layer sequences. That is to say that the display apparatus is a semiconductor light source. The semiconductor layer sequences are preferably formed from inorganic materials.

The semiconductor layer sequences are preferably each based on a III-V compound semiconductor material. The semiconductor material is for example a nitride compound semiconductor material such as $Al_nIn_{1-n-m}Ga_mN$, AlInGaN for short, or a phosphide compound semiconductor material such as $Al_nIn_{1-n-m}Ga_mP$, AlInGaP for short, or else an arsenide compound semiconductor material such as $Al_nIn_{1-n-m}Ga_m$ as or such as $Al_nGa_mIn_{1-n-m}As_kP_{1-k}$, AlInGaAs or AlInGaAsP for short, wherein in each case $0 \leq n \leq 1$, $0 \leq m \leq 1$ and $n+m \leq 1$ and also $0 \leq k < 1$. In this case, the semiconductor layer sequence can comprise dopants and additional constituents. For the sake of simplicity, however, only the essential constituents of the crystal lattice of the semiconductor layer sequence, that is to say Al, As, Ga, In, N or P, are specified, even if these can be replaced and/or supplemented in part by small amounts of further substances.

In accordance with at least one embodiment, the picture elements are controllable independently of one another. Consequently, an image is representable in a variable manner over time by way of the picture elements. Films can thus be represented by way of the display apparatuses. For example, the display apparatus is a display or a video wall.

In accordance with at least one embodiment, each of the picture elements has a plurality of types of pixels. In this case, each type of pixels is configured for emitting light of a specific color. Preferably, exactly three types of pixels are present in each picture element. The picture elements have for example exactly one pixel of each type in each case.

In accordance with at least one embodiment, the pixels are controllable independently of one another. The color impression of the light generated by the relevant picture element during operation is adjustable by way of the different control of the pixels.

In accordance with at least one embodiment, the pixels are each subdivided into a plurality of sub-pixels that are controllable independently of one another. All the sub-pixels of a pixel are configured for emitting light of the same color. That is to say that the sub-pixels of a pixel do not differ or do not differ significantly from one another with regard to the emitted light spectrum. At least two sub-pixels within each pixel have emission areas of different sizes. The emission areas here can in each case have the same basic geometric shape, for example square, rectangular, triangular or in the shape of a regular hexagon.

In accordance with at least one embodiment, an electrical control unit is assigned to each of the pixels. Preferably, the number of control units present per picture element is thus the same as the number of types of different pixels. As input variable, in particular as sole input variable, the control unit receives a current having an energization intensity for the relevant pixel. As output variable, in particular as sole output variable, the sub-pixels to be operated of the relevant pixel are output by the control unit or these sub-pixels are operated directly by the assigned control unit.

In accordance with at least one embodiment, the control units are each configured to preferably automatically control the sub-pixels of the relevant pixel depending on an energization intensity in such a way that a light-emitting area of the relevant pixel increases preferably in stepped fashion with the energization intensity. That is to say that the greater the energization intensity, the greater the number of sub-pixels controlled by the assigned control unit. The sub-pixels are preferably switched on at specific threshold current intensities. The threshold current intensities can be identical for all the types of pixels. Alternatively, different threshold current intensities are provided for the different types of pixels.

In at least one embodiment, the display apparatus comprises a multiplicity of picture elements for emitting visible light in different colors in an adjustable manner by means of preferably a plurality of semiconductor layer sequences. The picture elements are controllable independently of one another. Each of the picture elements has a plurality of types of pixels and each type of pixels is configured for emitting light of a specific color. The pixels are controllable independently of one another and are each subdivided into a plurality of sub-pixels that are controllable independently of one another. All the sub-pixels within a pixel are configured for emitting light of the same color out of the display apparatus without further color change. At least two sub-pixels within each pixel have emission areas of different sizes. An electrical control unit is assigned to each pixel. The control units are each configured to automatically control the sub-pixels of the relevant pixel depending on an energization intensity in such a way that a light-emitting area of the relevant pixel increases in stepped fashion with the energization intensity.

On account of the technological differences between nitride-based and phosphide-based light-emitting diode chips and on account of the differences in the typical chip sizes for red-, green- and blue-emitting chips in multi-LEDs, the turn-on times of the individual chips or pixels differ from one another significantly in part. The turn-on times essentially depend on the material system, the corresponding chip emission areas and the operating currents used.

Especially at low brightnesses and with high image refresh rates in video wall applications, that is to say with low operating currents or operating current densities, a red shift can usually be observed. That is to say that an image to be represented appears redder than desired. This is caused, in particular, by the fact that the turn-on times for green- and blue-emitting chips based on AlInGaN are significantly longer than for red-emitting chips based on AlInGaP.

The turn-on times of LED chips can be minimized by the chip sizes and thus the emission areas being chosen to be as small as possible, such that the ratio of the parasitic capacitances to the operating current becomes large. This stems from the fact that the turn-on time is approximately proportional to the quotient of the chip area and the forward current. Said quotient is in turn proportional to the chip capacitance divided by the forward current.

On the other hand, for high dynamic range applications, HDR for short, the LEDs are subject to the requirement of achieving maximum brightnesses which are orders of magnitude greater than the minimum brightnesses. A desired ratio of the maximum brightness to the minimum brightness is at least 500 000:1, for example. The problem to be solved technically then resides, in particular, in providing an LED which, on the one hand, has an optimum start-up behavior, that is to say short turn-on times, and can nevertheless satisfy the requirements in respect of brightness dynamic range.

Previous LEDs do not cover the entire requirement profile. Small LED chips, usually having chip areas of at most 250 μm×200 μm, are typically operated by means of multiplexing. The main aspect in the case of these LED chips is therefore directed at an optimized start-up behavior in order to prevent undesired effects such as red shifts. In this case, the maximum brightnesses that are achievable are limited by the limitation of the maximum electric currents of these LED chips and the greatly pronounced droop effect.

In the case of large LED chips, usually having chip areas of at least 250 μm×200 μm, other problems have occurred hitherto. If the distance between such LED components is increased in the application, then the operating mode normally changes to the effect that multiplex rates decrease or that the LED components are operated directly with DC current. Accordingly, the turn-on behavior becomes less important and the main aspect shifts to high brightnesses.

With the display apparatus described here, firstly a ratio of maximum to minimum brightness of at least 500 000:1 can be attained and at the same time a turn-on behavior such as is provided in the case of small LED chips is achievable.

Consequently, one aspect of the display apparatus described here resides in realizing pixels which are subdivided into a plurality of electrically isolated sub-pixels that can be turned on independently of one another, wherein the sub-pixels can be controlled separately from one another. The fact then of whether one or a plurality of sub-pixels simultaneously will be operated depends on the required brightness. The pixels can be subdivided into three regions, for example, corresponding to the sub-pixels:

- low brightness: only a small region is switched for operation. This results in the lowest capacitance, on account of the smallest active area, and thus the shortest switch-on delay;
- medium brightness: a plurality of regions are switched. It is thus possible to realize a medium brightness with a suitable current density. The relevant capacitance increases;
- maximum brightness: all regions are switched in order to realize the maximum brightness.

Consequently, a size—adapted to the requirements—of the effectively operated luminous area and thus also of the effective capacitance of the LEDs is realized in the case of the display apparatus described here. This can be realized in various ways with the aid of circuits realized in the pixel or in the periphery thereof, for example by:

- current-dependent switching on: if the LED is controlled with a higher current, then the system switches on further sub-pixels in order to realize a high dynamic range;
- actively controlled switching on: depending on the picture content, the effective luminous area of the segmented pixels is switched on directly or by means of a control signal.

What can thus be achieved in the case of the display apparatus described here is that the turn-on delay remains in an acceptable range even with low currents and that larger chip areas are switched on only as required. A large portion up to the entire display area can thus be used for representing contents. Higher display brightnesses are achievable. Lower minimum brightnesses are representable without a color shift, unlike in conventional displays, in which a driver current is often downwardly limited by system effects and IC tolerances. A best possible energy efficiency can be achieved without losses of picture quality. A significantly increased brightness dynamic range is thus accessible, in particular for HDR applications, without the disturbing color locus shifts at low brightnesses. In addition, a high energy efficiency is able to be realized as a result of the optimum operating range of the LEDs.

There are many possible implementations of this concept, on the basis of a simple control, integrated in or at the pixels. For example, the control unit for the pixels can be integrated in a silicon carrier on which the LED chips are fitted. A current-controlled, automatic control is effected for example by means of thyristors and/or by means of operational amplifiers, OAs for short.

In accordance with at least one embodiment, the picture elements each comprise one or a plurality of pixels for generating red light, for generating green light and for generating blue light. In particular, exactly one pixel in each case is present for red, green and blue light. The picture elements can thus be realized as RGB picture elements. For a larger color space or for an even higher dynamic range, further pixels can also be present, for example for yellow light, cyan-colored light and/or white light.

In accordance with at least one embodiment, the semiconductor layer sequences of the different types of pixels each have an active zone for generating the light of the relevant color. That is to say that the red, green and blue light is generated in each case by means of electroluminescence during operation. The semiconductor layer sequences for generating blue and green light are preferably based on InGaN and the semiconductor layer sequence for red light is preferably based on AlInGaP. The light is thus emitted by the display apparatus particularly preferably as generated in the semiconductor layer sequences, without a color change being effected by way of phosphors, for instance.

In accordance with at least one embodiment, the emission areas of the sub-pixels within a pixel increase logarithmically. That is to say, in particular, that for the i-th emission area $E_i$ of the i-th sub-pixel within a pixel, it holds true in each case that: $E_i = v \log_w(i+u)$, wherein v and w are real positive numbers and u is a real number greater than or equal to zero; u, v and w remain the same within a pixel. i is a counting index for the sub-pixels, ordered according to ascending size. That is to say, in other words, that all $E_i$ of a sub-pixel can lie on the curve $f(x)=v \log_w(x+u)$, wherein x is an abscissa coordinate.

In accordance with at least one embodiment, for a number N of sub-pixels per pixel it holds true that: $2 \leq N \leq 20$ or $3 \leq N \leq 15$ or $4 \leq N \leq 10$ or $4 \leq N \leq 8$.

In accordance with at least one embodiment, the emission areas of the sub-pixels within a pixel increase within a power law. That is to say, in particular, that for the i-th emission area $E_i$ of the i-th sub-pixel within a pixel, it holds true in each case that: $E_i=v\, w^{(i+u)}$, wherein v and w are real positive numbers and u is a real number greater than or equal to zero, and additionally $w>1$. u, v and w remain the same within a pixel. i is a counting index for the sub-pixels, ordered according to ascending size. That is to say, in other words, that all $E_i$ of a sub-pixel can lie on the curve $f(x)=v\, w^{(x+u)}$.

In accordance with at least one embodiment, the electrical control units are in each case fitted in pixel proximity. That is to say that a distance between the relevant control unit and the assigned pixel is at most $0.5*\sqrt{E_{tot}}$, wherein $E_{tot}$ is the sum of all the emission areas of the assigned pixel. Preferably, said distance is at most $0.2*\sqrt{E_{tot}}$, or at most $0.1*\sqrt{E_{tot}}$.

In accordance with at least one embodiment, all the sub-pixels of a pixel are integrated in a common semiconductor chip, in particular in a common LED chip. That is to say that the relevant pixel can be a pixelated LED chip. Depending on the grouping of the pixels over the picture elements, a plurality of pixels—emitting the same color—of different picture elements can also be accommodated in a common pixelated LED chip.

In accordance with at least one embodiment, all the sub-pixels within a pixel and/or all the pixels within a picture element each have a common and/or continuous active zone of the relevant semiconductor layer sequence. That is to say that the pixels and/or the picture elements can be embodied monolithically with regard to the semiconductor layer sequence.

Alternatively, it is possible for the sub-pixels for the relevant pixel or the relevant picture element to be produced from the same semiconductor layer sequence. In this case, a subdivision into the sub-pixels is effected in particular by complete removal of the semiconductor layer sequence between adjacent sub-pixels, in particular by means of etching. In this case, a relative position of the sub-pixels with respect to one another preferably does not change during the subdivision of the semiconductor layer sequence.

That is to say, therefore, that the sub-pixels can have the same semiconductor layer sequence. This is verifiable by way of transmission electron microscopy, for example, since the sub-pixels have the same layering within the semiconductor layer sequence and the same layer thicknesses. A layering and precise layer thicknesses of the individual partial layers of the semiconductor layer sequence are a type of fingerprint that makes it possible to ascertain whether the sub-pixels are actually based on the same semiconductor layer sequence.

In accordance with at least one embodiment, some or all of the sub-pixels of a pixel are formed by separate semiconductor chips, in particular by separate LED chips. The individual pixels are then composed of a plurality of LED chips.

In accordance with at least one embodiment, the semiconductor chips for the sub-pixels are arranged on a common intermediate carrier. The intermediate carrier can be a so-called submount. It is possible for the intermediate carrier not to be functionalized electrically beyond a wiring. Preferably, however, the intermediate carrier comprises the at least one assigned control unit for the relevant pixel(s). In the last-mentioned case, the intermediate carrier is an IC chip and/or a silicon chip, for example.

In accordance with at least one embodiment, a plurality of the pixels or all the pixels are arranged on a common intermediate carrier. Preferably, the intermediate carrier comprises the assigned control units. By way of example, the intermediate carrier is a silicon wafer or a part of such a wafer. In addition to the control units for the sub-pixels, the intermediate carrier can also comprise address units or storage units for controlling the picture elements.

In accordance with at least one embodiment, the sub-pixels of a pixel and the assigned control unit are integrated in a common semiconductor chip. In particular, exactly one semiconductor chip is present per pixel. Alternatively, there can be exactly one semiconductor chip per picture element, all the sub-pixels of the relevant pixels and the assigned control units being integrated in said semiconductor chip.

In accordance with at least one embodiment, the sub-pixels of a pixel and the assigned control unit are arranged in overlapping fashion as seen in a plan view of the relevant emission areas. That is to say that the emission areas can partly or completely cover the relevant control unit. Alternatively, the control unit of a pixel is situated next to the emission areas, as seen in plan view.

In accordance with at least one embodiment, the control units in each case comprise one or a plurality of thyristors. Preferably, exactly one thyristor is present for all the sub-pixels of a pixel, with the exception of a single sub-pixel per pixel.

In accordance with at least one embodiment, the thyristors are controlled with the aid of operational amplifiers. A one-to-one assignment can be present between the thyristors and operational amplifiers.

In accordance with at least one embodiment, all the sub-pixels, apart from the sub-pixel having the smallest emission area, are connected to outputs of the associated thyristors and/or operational amplifiers. The sub-pixel having the smallest emission area within a pixel can be connected to a current line for energizing the pixel without control directly or via an electrical resistor.

In accordance with at least one embodiment, the control units are in each case configured to switch on the sub-pixels of a pixel, ordered according to the size of the emission areas, progressively as the energization intensity increases. That is to say, in particular, that within a pixel the sub-pixels having a larger emission area are operated only when all the sub-pixels having a smaller emission area have been turned on. For example, the second smallest sub-pixel is operated only when the smallest sub-pixel has been turned on, and the third smallest sub-pixel is operated only when the smallest and second smallest sub-pixels have been turned on, and so on.

In accordance with at least one embodiment, the control units are in each case configured to switch on the sub-pixels of a pixel in accordance with the energization intensity encoded as a binary number, such that the sizes of the emission areas of the sub-pixels respectively correspond to a significance of the assigned digit of the binary number. In this case, the sizes of the emission areas preferably increase from sub-pixel to sub-pixel by a factor of two, such that the size ratios are then 1:2:4:8 and so on. If, for example, the energization intensity is encoded with the numerical value 13, binary 1101, then the smallest, third smallest and fourth smallest sub-pixels are operated. If N sub-pixels are present, then the energization intensity is subdivided for example into $2^N$ steps of equal size, inclusive of an energization intensity of zero.

In accordance with at least one embodiment, the display apparatus is a cinema screen or home cinema screen with high dynamic range capability.

In accordance with at least one embodiment, the display apparatus is configured to emit a luminance of at least 5000 nits or 6000 nits or 7000 nits at certain times and at certain regions. By contrast, a typical brightness of cinema screens or home cinema screens operated in darkened rooms is usually between 500 nits and 1200 nits. That is to say that, with the display apparatus described here, very high brightnesses can be displayed at least momentarily and at certain places.

In accordance with at least one embodiment, the display apparatus is configured for the representation of films in the 4K and/or UHD video format. In other words, it can be a 4K2K display. In the 4K format, there are in particular 4096 times 2160 RGB picture elements designed as RGB picture elements. In the UHD format, also referred to as Ultra High Definition, there are 3840 times 2160 RGB picture elements.

In accordance with at least one embodiment, the display apparatus is configured for representing high-contrast images, also referred to as HDR. HDR images are encoded for example with at least 10 bits for the brightness, preferably with at least 12 bits or 14 bits or 15 bits. The brightness encoding can be effected linearly or nonlinearly. By contrast, digital images having a low dynamic range, also referred to as low dynamic range images or LDR images for short, usually only have a brightness encoding of 7 bits or 8 bits.

In accordance with at least one embodiment, the pixels or at least some of the pixels comprise a phosphor for changing the color of at least one portion of the light, as generated in the semiconductor layer sequences or in the semiconductor layer sequence. By way of example, then all the semiconductor layer sequences are based on AlInGaN, or the semiconductor layer sequence is based on AlInGaN, preferably only the red light being generated by means of a phosphor.

Furthermore, a method of operation for such a display apparatus is specified. In this case, the display apparatus is designed as described in association with one or more of the embodiments mentioned above. Features of the method of operation are therefore also disclosed for the display apparatus, and vice versa.

In at least one embodiment of the method of operation, the picture elements of the display apparatus are operated at certain times or permanently such that the light-emitting area of the relevant pixels increases in stepped fashion with the energization intensity.

A display apparatus described here and a method of operation described here are explained in greater detail below on the basis of exemplary embodiments with reference to the drawing. In this case, identical reference signs indicate identical elements in the individual figures. In this case, however, relations to scale are not illustrated; rather, individual elements may be illustrated with an exaggerated size in order to afford a better understanding.

Figure 2:
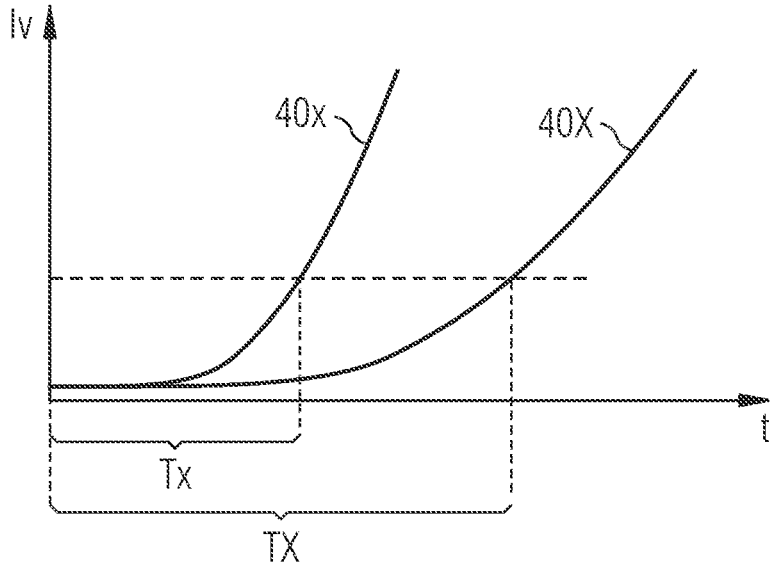
Figure 3:
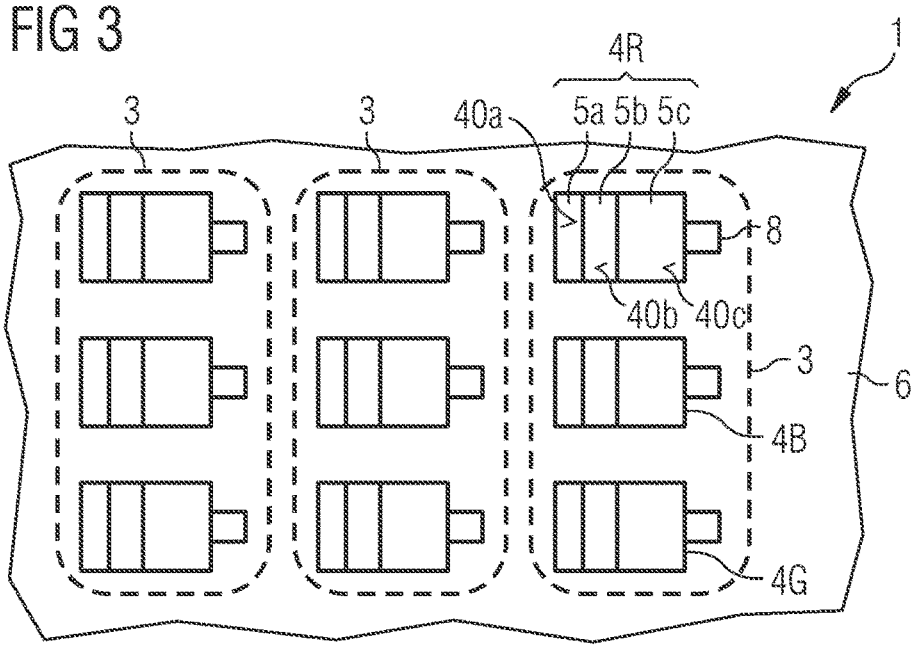
Figure 4:
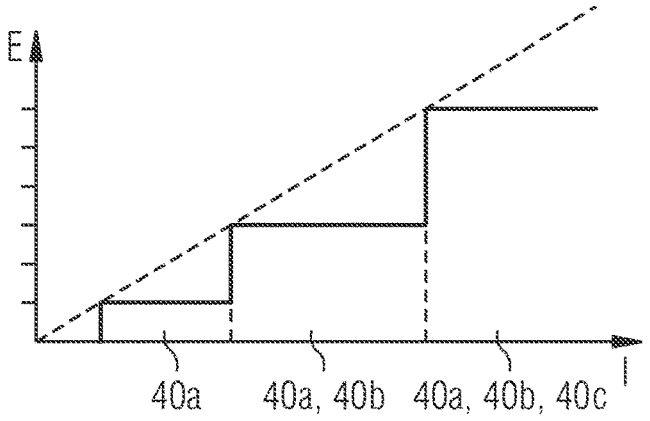
Figure 5:
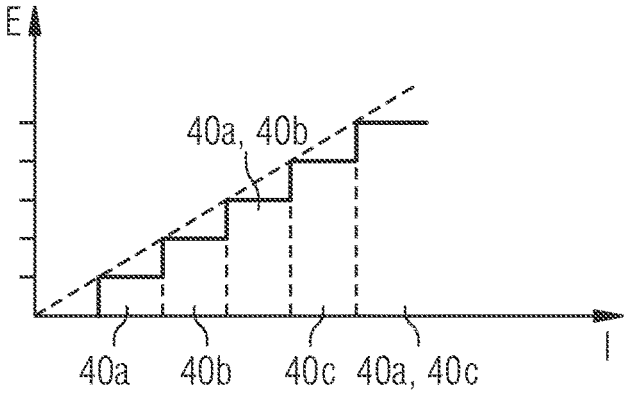
Figure 6:
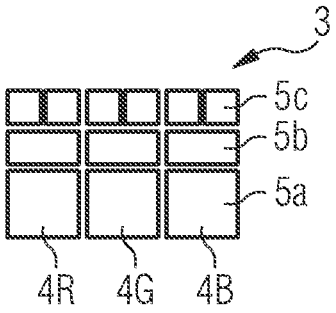
Figure 7:
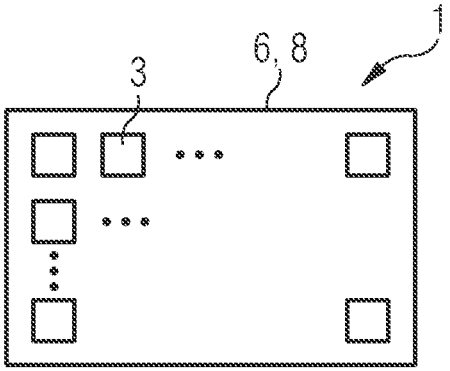
Figure 8:
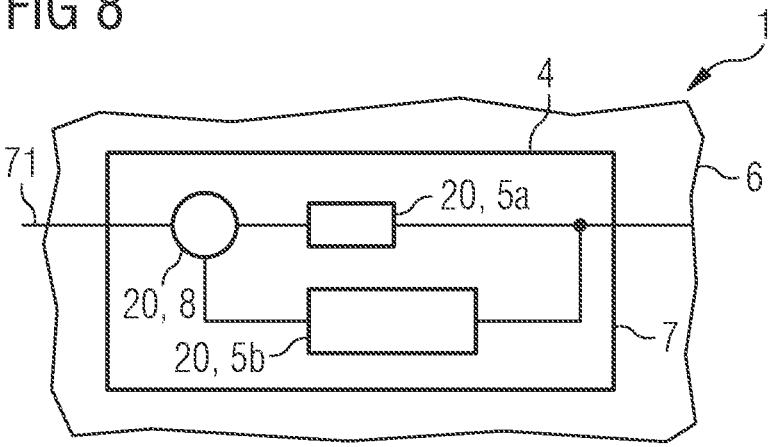
Figure 9:
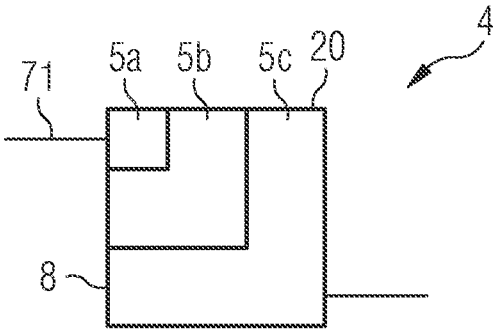
Figure 13:
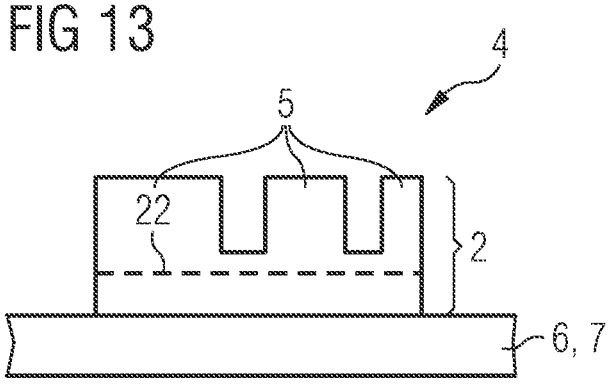
Figure 14:
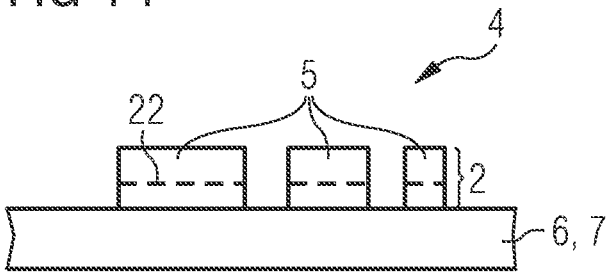
Figure 15:
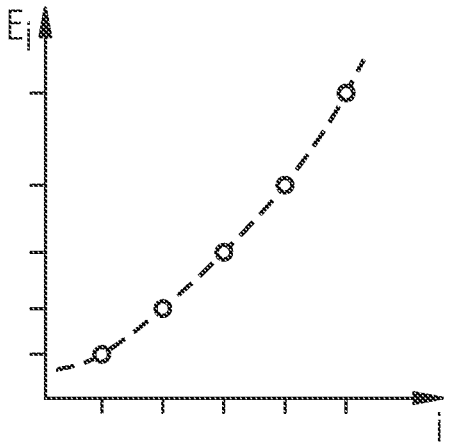
Figure 16:
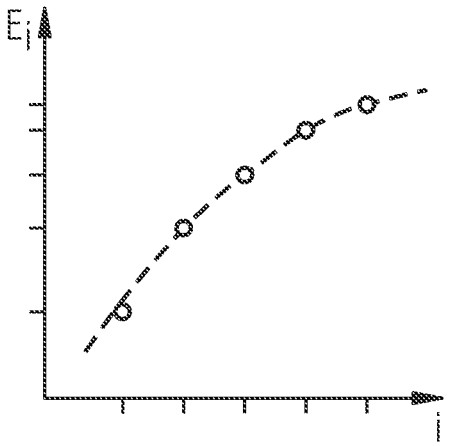
Figure 17:
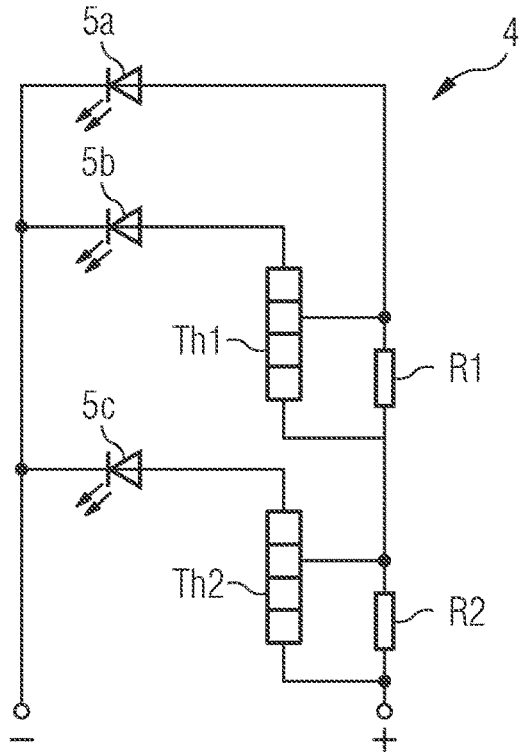
Figure 18:
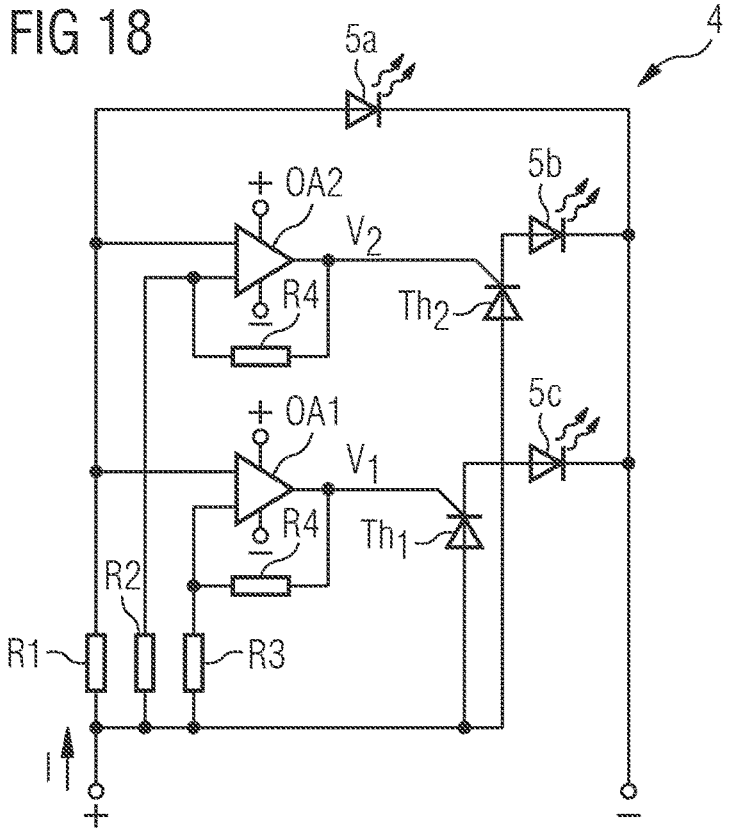
Figure 19:
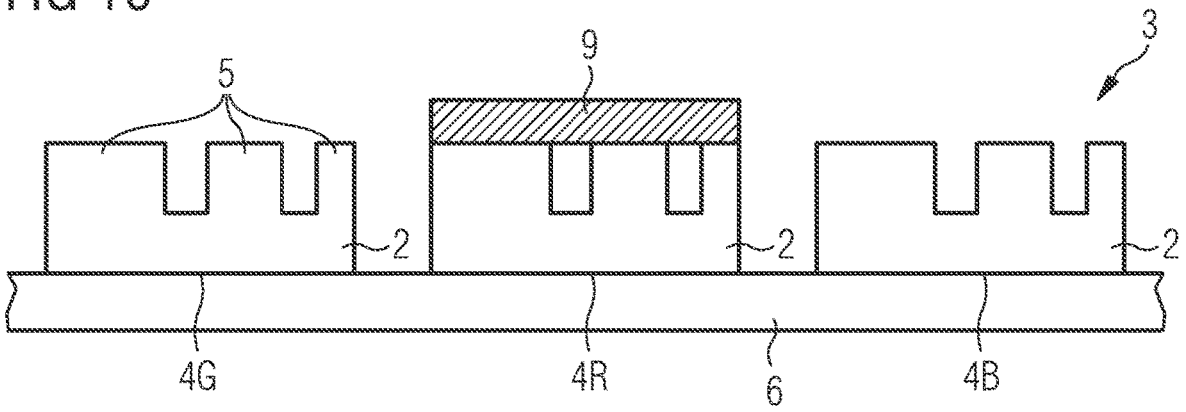

In the figures:

FIGS. 1 and 2 show schematic illustrations of a switch-on delay as a function of a semiconductor material and a chip size, FIG. 3 shows a schematic plan view of one exemplary embodiment of a display apparatus described here, FIGS. 4 and 5 show schematic illustrations of an emission area as a function of an energization intensity for exemplary embodiments of display apparatuses described here, FIG. 6 shows a schematic plan view of a picture element for exemplary embodiments of display apparatuses described here, FIG. 7 shows a schematic plan view of one exemplary embodiment of a display apparatus described here, FIGS. 8 and 9 show schematic plan views of pixels for exemplary embodiments of display apparatuses described here, FIGS. 10 to 14 show schematic sectional illustrations of exemplary embodiments of pixels for display apparatuses described here, FIGS. 15 and 16 show schematic illustrations of a profile of the emission area over the sub-pixels of a pixel for exemplary embodiments of display apparatuses described here, FIGS. 17 and 18 show schematic illustrations of exemplary embodiments of pixels for display apparatuses described here, and FIG. 19 shows a schematic sectional illustration of a picture element for exemplary embodiments of display apparatuses described here.

FIG. 1 shows a diagram of a temporal profile of the light intensity Iv for continuous emission areas 40R, 40G, 40B for generating red, green and blue light, respectively. The emission areas 40R, 40G, 40B are based on the material system AlInGaP for red light and on AlInGaN for green and blue light. This results in a different intrinsic switch-on delay TR, TG, TB for each of the emission areas 40R, 40G, 40B. The illustration in FIG. 1 applies to emission areas 40R, 40G, 40B embodied with the same size within the scope of the manufacturing tolerances.

In the event of simultaneous control of the emission areas, therefore, firstly electromagnetic radiation is emitted by the emission areas 40R in the red spectral range, followed only then by the beginning of the emission of radiation in the second and third emission areas 40G, 40B with a short temporal separation between them.

The intrinsic switch-on delays Tx, TX of different magnitudes can also arise as a result of a parasitic capacitance of different magnitudes at the respective emission areas 40*x*, 40X. Causes of a different parasitic capacitance can be, for example, different lateral dimensions of the emission areas 40*x*, 40X. In this regard, the emission area 40*x* in FIG. 2 is smaller than the emission area 40X. Accordingly, the switch-on delay Tx is shorter than the switch-on delay TX.

Such a staggered emission of electromagnetic radiation of different wavelengths can no longer be perceived by an observer as a single mixed color, under certain circumstances, but rather can bring about the impression of a sequence of different color perceptions. Furthermore, such a high temporal difference between the switch-on points in time can have the effect that the pixels 4G, 4B with the highest intrinsic switch-on delay TG, TB within a limited time window of a pulse width modulation period during the representation of moving picture contents can be excited to emission only in part. This can give rise to an undesired deviation in the mixed color represented, in particular a red cast.

FIG. 3 illustrates an exemplary embodiment of a display apparatus 1. Many picture elements 3 are applied to a carrier 6. The picture elements 3 in each case comprise three pixels 4R, 4G, 4B for generating red, green and blue light. The pixels 4R, 4G, 4B in each case comprise a semiconductor layer sequence, not illustrated in FIG. 3.

As seen in plan view, the pixels 4R, 4G, 4B are in each case subdivided into for example three sub-pixels 5*a*, 5*b*, 5*c*. The sub-pixels 5*a*, 5*b*, 5*c* have emission areas 40*a*, 40*b*, 40*c* of different sizes and are controllable independently of one another. To that end, each of the pixels has a control unit 8 that controls the sub-pixels 5*a*, 5*b*, 5*c* depending on an energization intensity.

The control is illustrated schematically in FIG. 4. The greater the energization intensity I, the greater the number of sub-pixels 5*a*, 5*b*, 5*c* that are operated. In the case of very low energization intensities I, as yet no sub-pixels 5*a*, 5*b*, 5*c* are operated; subsequently, only the emission area 40*a* of the sub-pixel 5*a* emits light. The further sub-pixels 5*b*, 5*c* having the emission areas 40*b*, 40*c* are progressively switched on, thus resulting in a stepped profile of the emission area E operated overall as a function of the energization intensity I. The corner points of the individual steps at the jumps can lie on a straight line, in particular on a straight line extending through the origin.

FIG. 5 schematically describes an alternative switching of the sub-pixels 5*a*, 5*b*, 5*c*, such that a smoother profile with smaller step heights is attainable. In this case, the energization intensity I is expressed as a binary number and the sub-pixels 5*a*, 5*b*, 5*c* are assigned to individual digits of the binary number, wherein the significance of the digits corresponds to the size of the sub-pixels 5*a*, 5*b*, 5*c*. In this case, the sizes of the emission areas 40*a*, 40*b*, 40*c* are preferably in a ratio of 1:2:4:8 and so on.

FIG. 6 illustrates a further exemplary embodiment of a picture element 3. Per pixel 4R, 4G, 4B, a plurality of sub-pixels 5*a*, 5*b*, 5*c* of different sizes are present, for example in each case four of the sub-pixels 5. The sub-pixels 5*a*, 5*b* are designed such that they are comparatively large and rectangular in each case. The smallest sub-pixels 5*c* are square in shape, as seen in plan view, and can be present twice. A size ratio of the sub-pixels 5*a*, 5*b*, 5*c* to one another is 4:2:1. The control units are not illustrated in FIG. 6.

FIG. 7 illustrates a further exemplary embodiment of a display apparatus 1. The picture elements 3 are applied on a carrier 6 in matrix form in a regular square or rectangular pattern, the control units 8 being integrated in the carrier 6. The carrier 6 is a printed circuit board, for example. The individual picture elements 3 are preferably constructed as illustrated in FIG. 3, alternatively as illustrated in FIG. 6.

The display apparatus 1 is preferably suitable for 4K and has approximately 4000×2000 of the picture elements 3. The picture elements 3 are electrically controllable independently of one another. The picture elements 3 are controlled via the carrier 6.

FIG. 8 illustrates that the control unit 8 is embodied as a current switch. The control unit 8 and the for example only two sub-pixels 5*a*, 5*b* of the pixel 4 are designed in each case as a dedicated semiconductor chip 20 and fitted for example on an intermediate carrier 7, for instance a submount. An electrical connection is effected via conductor tracks 71.

In FIG. 9, by contrast, the entire pixel 4 is a separate semiconductor chip 20, into which the sub-pixels 5*a*, 5*b*, 5*c* and the control unit 8 are integrated. The sub-pixels 5*a*, 5*b*, 5*c* thus cover the control unit 8.

Figure 10:
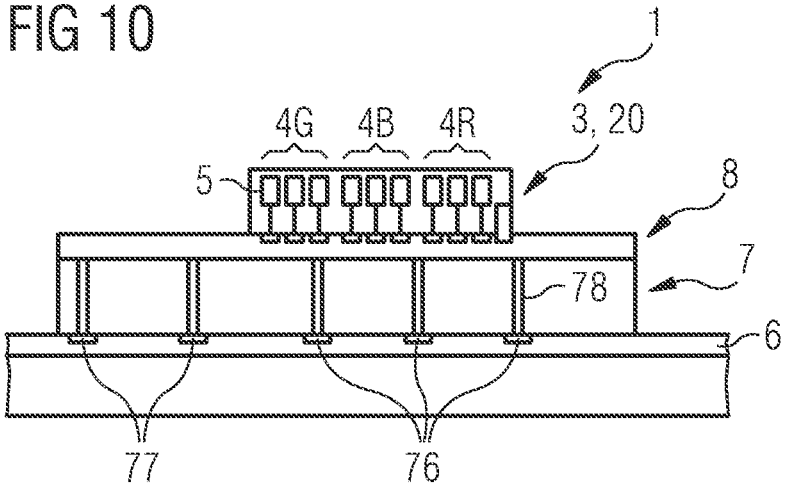

FIG. 10 shows a further exemplary embodiment of a display apparatus 1, wherein only one of the picture elements 3 is illustrated in order to simplify the illustration. The picture element 3 is formed by a single semiconductor chip 20, as is also possible in all the other exemplary embodiments. The individual sub-pixels 5 of the pixels 4G, 4B, 4R for generating green, blue and red light are monolithically integrated in the semiconductor chip 20 for the picture element 3.

The semiconductor chip 20 for the picture element 3 is fitted on the intermediate carrier 7, for example. The intermediate carrier 7 is based on silicon, in particular, and comprises a control circuit 75. The control circuit 75 is produced using CMOS technology in a layer of the intermediate carrier 7 that is closest to the semiconductor chip 20. The individual sub-pixels 5 can thus be electrically addressed and controlled via the control unit 8 of the intermediate carrier 7.

The intermediate carrier 7 is situated on the carrier 6. For this purpose, the intermediate carrier 7 and accordingly the carrier 6 have a plurality of electrical connection areas 76, 77. By way of example, three connection areas 76 are present for supplying energy to the intermediate carrier 7 and the picture elements 3. Moreover, by way of example, two connection areas 77 are present for a data line. An electrical connection between the connection areas 76, 77 and the control circuit 75 is effected via electrical through contacts 78, for example.

Between the semiconductor chip 20 having the sub-pixels 5 and the control circuit 75 there is for example one electrical connection more than the number of sub-pixels 5. The semiconductor chips 20 having the sub-pixels 5 can be soldered or adhesively bonded onto the intermediate carrier 7 or else be secured thereto by way of direct bonding or wafer bonding. Direct bonding or wafer bonding is employed particularly if the semiconductor chip 20 having the sub-pixels 5 is designed as a substrateless chip without a growth substrate and then has for example a thickness of at least 2 μm and/or at most 12 μm.

Figure 11:
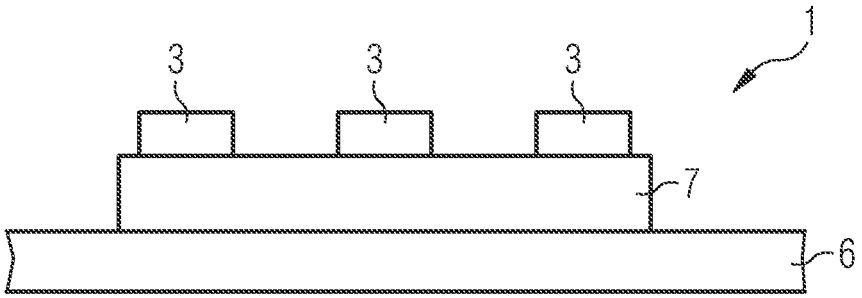

The exemplary embodiment in FIG. 11 illustrates that a plurality of the picture elements 3 are applied jointly on the intermediate carrier 7. A wiring and a number of conductor tracks on the carrier 6 can thus be reduced. A wiring is effected via the intermediate carrier 7 to an increased extent.

Figure 12:
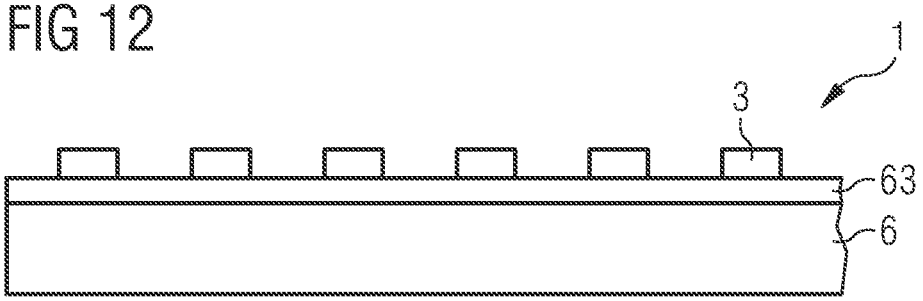

The exemplary embodiment in FIG. 12 illustrates that a thin-film transistor array 63 is fitted to the carrier 6. The picture elements 3 are electrically controlled via the thin-film transistor array 63. The picture elements 3 can thus be applied directly to the carrier 6.

In the exemplary embodiments of the pixels 4 such as can be seen in FIGS. 13 and 14, the pixels 4 are in each case fabricated from a single semiconductor layer sequence 2. In accordance with FIG. 13, an active zone 22 of the semiconductor layer sequence extends continuously across all the sub-pixels 5. The semiconductor layer sequence 2 is partly removed between adjacent sub-pixels 5, such that the sub-pixels 5 are electrically controllable independently of one another and no or no significant electrical transverse conductivity occurs between adjacent sub-pixels 5 within the semiconductor layer sequence 2. For this purpose, it is also possible, in a departure from the illustration in FIG. 13, for the active zone 22 also to be severed, the semiconductor layer sequence 2 being maintained as a continuous layer sequence.

By contrast, in accordance with FIG. 14, the semiconductor layer sequence 2 is completely removed between adjacent sub-pixels 5. In this case, during the production of the sub-pixels 5, their relative position with respect to one another is not altered during application to the carrier 6 or the intermediate carrier 7 in comparison with a growth substrate. The semiconductor layer sequence 2 thus extends with an unchanged, constant composition across the sub-pixels 5, disregarding the gaps between the sub-pixels 5.

The gaps between adjacent sub-pixels 5 are preferably at least 0.2 μm or 0.5 μm or 1 μm and/or at most 10 μm or 5 μm or 2 μm. This preferably also applies to all the other exemplary embodiments.

As also in all the other exemplary embodiments, the display apparatus 1 is preferably free of phosphors for a wavelength conversion. That is to say that the radiation generated in the respective semiconductor layer sequence 2 is emitted by the display apparatus 1 preferably directly without wavelength conversion. Notwithstanding that, color filters that only remove wavelength components, but—unlike in the case of wavelength conversion—do not add wavelength components, can optionally be present.

As also in all the exemplary embodiments, it is possible for an optical isolation, not depicted, to be introduced between adjacent pixels 4R, 4G, 4B, for example by way of diffusely reflective potting materials or by way of specularly reflective metals, for example in trenches in the semiconductor layer sequence 2.

The picture elements 3 described here can be controlled with regard to a brightness for example with a 10-bit dimming in order to attain a high brightness dynamic range. It is possible for the 10-bit control to be obtained from an 8-bit data set or a 7-bit data set by means of expansion or interpolation in order to extend the brightness range.

FIGS. 15 and 16 show how the sizes of the emission areas $E_i$ of the i-th sub-pixel are in a ratio to one another. In this regard, the emission areas $E_i$ lie on the curve of a power function in accordance with FIG. 15 and on the curve of a logarithmic function in accordance with FIG. 16.

FIGS. 17 and 18 illustrate exemplary circuits that can be used to realize the control units 8 for pixels 4 described here.

In accordance with FIG. 17, thyristors Th1, Th2 are used in order to supplementarily switch on the sub-pixels 5*b*, 5*c*, depending on the energization intensity. A respective resistance R1, R2 is electrically connected in parallel with the thyristors Th1, Th2, such that a respective gate of the thyristors Th1, Th2 is controlled by way of a voltage drop across the resistances R1, R2. The resistance R1 is greater than the resistance R2 for example by the same factor by which the luminous areas of the associated sub-pixels 5*b*, 5*c* differ from one another. For example, the resistance R1 is approximately 0.05Ω and the resistance R2 is approximately 0.1Ω. The sub-pixel 5*a* is controlled directly, that is to say without a thyristor.

In the case of the exemplary embodiment in accordance with FIG. 18, there are only smaller or no resistances in the main current path, with the result that a higher efficiency is attainable. The thyristors Th1, Th2 are respectively controlled via the operational amplifiers OA1, OA2. Resistances R2, R3 are connected upstream of the operational amplifiers OA1, OA2 and resistances R4 are connected in parallel with said operational amplifiers.

Depending on a size ratio of the assigned sub-pixels 5*b*, 5*c*, it preferably holds true that R3≈R2/2. It preferably holds true, moreover, that R4>>R3 and/or R4>>R2. For the switch-on voltage V1 at the thyristor Th1 it holds true that, in particular, V1=I R1 (1+R4/R3) and, for the switch-on voltage V2 at the thyristor Th2, it correspondingly holds true that V2=I R1 (1+R4/R2). For the resistance R1 it preferably holds true that R1<<1Ω, such that R1 can be regarded as line resistance.

If more than three sub-pixels 5*a*, 5*b*, 5*c* are present, correspondingly more thyristors and/or operational amplifiers should be provided.

In the case of the picture element 3 in FIG. 19, all the semiconductor layer sequences 2 are based on the material system AlInGaN. The pixel 4R for generating red light therefore comprises a phosphor 9 in order to generate red light from blue or from green light as generated by the assigned semiconductor layer sequence 2. In a departure from the illustration in FIG. 19, the phosphor 9 can be structured with respect to the sub-pixels 5 in the same way as the semiconductor layer sequence 2.

Furthermore, in a departure from the illustration in FIG. 19, it is possible for there to be a continuous semiconductor layer sequence having electrically independently controllable regions for the pixels and for the sub-pixels, wherein a plurality of different phosphors, for example for generating green and red light from blue light, are then disposed downstream of said semiconductor layer sequence.

The invention described here is not restricted by the description on the basis of the exemplary embodiments. Rather, the invention encompasses any novel feature and also any combination of features, which in particular includes any combination of features in the patent claims, even if this feature or this combination itself is not explicitly specified in the patent claims or exemplary embodiments.

LIST OF REFERENCE SIGNS

1 Display apparatus
2 Semiconductor layer sequence
20 Semiconductor chip
22 Active zone
3 Picture element
4 Pixel
40 Light-emitting area/emission area
5 Sub-pixel
50 Emission area
6 Carrier
63 Thin-film transistor array
7 Intermediate carrier
71 Electrical conductor track
76 Connection area for energy supply
77 Connection area for data line
78 Electrical through contact
8 Electrical control unit
9 Phosphor
$E_{tot}$ Total area of all emission areas taken together
I Energization intensity
Iv Light intensity
OA Operational amplifier
R Resistance
T Turn-on time
Th Thyristor

The invention claimed is:

1. A display apparatus comprising a multiplicity of picture elements for emitting visible light in different colors in an adjustable manner by means of a plurality of semiconductor layer sequences, wherein each of the picture elements has a plurality of types of pixels and each type of pixel is configured for emitting light of a specific color, the pixels are each subdivided into a plurality of sub-pixels and all the sub-pixels are configured for emitting light of the same color out of the display apparatus without further color change, at least two sub-pixels within each pixel have emission areas of different sizes, an electrical control unit is assigned to each pixel, the control units are each configured to automatically control the sub-pixels of a relevant pixel depending on an energization intensity in such a way that a light-emitting area of the relevant pixel increases in stepped fashion with the energization intensity, and the control units each comprise a plurality of thyristors that switch on a corresponding sub-pixel in response to the energization intensity being greater than a preset threshold assigned to each of the thyristors of the plurality of thyristors.

2. The display apparatus as claimed in claim 1, wherein each of the picture elements is formed from a pixel for emitting red light, a pixel for emitting green light and a pixel for emitting blue light, and wherein the pixels for emitting green and blue light have a semiconductor layer sequence based on AlInGaN and the pixels for emitting red light have a semiconductor layer sequence based on AlInGaP, such that the green, blue and red light is emitted by the display apparatus without color change and as generated in the semiconductor layer sequences.

3. The display apparatus as claimed in claim 1, wherein the emission areas of the sub-pixels within a pixel increase logarithmically.

4. The display apparatus as claimed in claim 1, wherein the emission areas of the sub-pixels within a pixel increase in accordance with a power law.

5. The display apparatus as claimed in claim 1, wherein the electrical control units are fitted in each case in pixel proximity, such that a distance between the relevant control unit and the assigned pixel is at most $0.5*\sqrt{E_{tot}}$ and $E_{tot}$ is the total area of all the emission areas of the assigned pixel.

6. The display apparatus as claimed in claim 1, wherein all the sub-pixels of a pixel are integrated in a common semiconductor chip.

7. The display apparatus as claimed in claim 1, wherein at least some of the sub-pixels of a pixel are formed by separate semiconductor chips.

8. The display apparatus as claimed in claim 7, wherein the semiconductor chips for the sub-pixels are arranged on a common intermediate carrier comprising the assigned control unit of the relevant pixel.

9. The display apparatus as claimed in claim 1, wherein a plurality of the pixels or all the pixels are arranged on a common intermediate carrier comprising the assigned control units.

10. The display apparatus as claimed in claim 1, wherein the sub-pixels of a pixel and the assigned control unit are integrated in a common semiconductor chip.

11. The display apparatus as claimed in claim 1, wherein the sub-pixels of a pixel and the assigned control unit are arranged in overlapping fashion as seen in a plan view of the relevant emission areas.

12. The display apparatus as claimed in claim 1, wherein the thyristors are controlled with the aid of operational amplifiers, wherein all the sub-pixels apart from the sub-pixel having the smallest emission area are connected to outputs of the associated thyristors and the sub-pixel having the smallest emission area is connected to a current line without control.

13. The display apparatus as claimed in claim 1, wherein the control units are in each case configured to switch on the sub-pixels of a pixel, ordered according to the size of the emission areas, progressively as the energization intensity increases, such that within a pixel the sub-pixels having a larger emission area are operated only when all the sub-pixels having a smaller emission area have been turned on.

14. The display apparatus as claimed in claim 1, wherein the control units are in each case configured to switch on the sub-pixels of a pixel in accordance with the energization intensity encoded as a binary number, such that the sizes of the emission areas of the sub-pixels respectively correspond to a significance of the assigned digit of the binary number.

15. The display apparatus as claimed in claim 1, which is a cinema screen with high dynamic range capability, and wherein the display apparatus is configured to emit a luminance of at least 6000 nits at certain times and at certain regions.

16. A method of operation for a display apparatus as claimed in claim 1, wherein the sub-pixels are controlled by the control units per pixel in such a way that the light-emitting area of the relevant pixel increases in stepped fashion with the energization intensity.

* * * * *